US006123418A

United States Patent [19]

Wakahara et al.

[11] Patent Number: 6,123,418

[45] Date of Patent: Sep. 26, 2000

[54] IMAGE FORMING APPARATUS USING JUMPING TONER/DEVELOPER

[75] Inventors: Shirou Wakahara, Osaka; Nobuhiko Nakano, Nara, both of Japan

[73] Assignee: Sharp Kabushiki Kaisha, Osaka, Japan

[21] Appl. No.: 09/021,910

[22] Filed: Feb. 11, 1998

[30] Foreign Application Priority Data

Feb. 21, 1997 [JP] Japan ..... 9-038170

[51] Int. Cl.[7] ..... B41J 2/06

[52] U.S. Cl. ..... 347/55

[58] Field of Search ..... 347/55, 120, 123, 347/111, 159, 141, 17, 103, 154; 399/271, 290, 292, 293, 294, 295

[56] References Cited

FOREIGN PATENT DOCUMENTS

| | | |
|---|---|---|
| 0 754 557 | 1/1997 | European Pat. Off. . |
| 0 769 384 | 4/1997 | European Pat. Off. . |
| 7-178953 | 7/1995 | Japan . |
| 9-193443 | 7/1997 | Japan . |

*Primary Examiner*—John Barlow
*Assistant Examiner*—Raquel Yvette Gordon
*Attorney, Agent, or Firm*—Dike, Bronstein, Roberts & Cushman, LLP; David G. Conlin; William J. Daley, Jr.

[57] ABSTRACT

Formed between an opposing electrode and a toner support by a high voltage applied from a high-voltage power source is an electric field required for the toner carried on the toner support to jump toward the opposing electrode. The high-voltage power source and the duration of voltage application are adjusted so as to pick out suitable developer particles to be used for forming images.

4 Claims, 8 Drawing Sheets

2
3
4
5
6
7
8
10
11
12
13
14
15
16a
16b
17
18
19
20
21
22
23
24
25
26
27
28
29
30
31
39
40
80
A

Flowchart at the start of operation

IMAGE FORMING APPARATUS USING JUMPING TONER/DEVELOPER

BACKGROUND OF THE INVENTION (1.) Field of the Invention

The present invention relates to an image forming apparatus which forms images on the recording medium by causing the developer to jump thereto and can be applied to a printer unit in digital copiers and facsimile machines as well as to digital printers, plotters, etc.

(2.) Description of the Prior Art

In recent years, as the image forming means for outputting a visual image on recording medium such as recording paper etc., in response to an image signal, there have been various technologies such as Japanese Patent Application Laid-Open Hei 7 No. 178,953 as well as Japanese Patent Application Laid-Open Hei 9 No. 193443 which was filed by the present applicant. In these disclosures, image forming apparatuses have been proposed in which charged particles are placed in an electric field so that they will jump by electric force to adhere to the recording medium whilst the potential to be applied to the control electrode having a number of passage holes located in the jump path is being varied, to thereby form an image on the recording medium, directly. In the above techniques of the prior art, the control electrode has a single driver configuration, and the application time of voltage and the toner discriminating method suited to image forming are described.

In a type of image forming apparatus of the above prior art, the passage of the charged particles through the gates is controlled in accordance with the data of an image so as to produce dots of the image data on a sheet of paper as the recording medium thus creating the image. In this process, in order to allow the toner to pass through gates and reach the paper thereby forming dots on it, a voltage is applied continuously for a predetermined period of time. This continuous period of time for voltage application is long enough to make the toner reach the control electrode. Then, the potential of the control electrode is switched to a voltage at which no toner will jump immediately after the toner has passed by the control electrode. This control of timing makes it possible to achieve improved speed of printing.

In the technology disclosed in Japanese Patent Application Laid-Open Hei 7 No. 178,953, the toner unsuitable for image forming is removed from the toner support before the toner arrives at the position facing the gates. This configuration needs additional removing means such as a roller, power source etc. Besides, in some cases, the toner may present different characteristics between the time when the toner faces the removing means and when the toner faces the gates. Resultantly, it is not the case that only toner having the correct characteristics will be used for image forming.

In the technology disclosed in Japanese Patent Application Laid-Open Hei 9 No. 193443, the potential enabling toner to jump continues to be applied until all the toner involved has passed by the control electrode. From the view point of the printing time, the voltage causing the toner to jump must continuously be applied until the toner has passed by the control electrode. Accordingly, this imposes a limit on reducing the duration of voltage application per dot, resulting in difficulty in increasing the printing speed further still.

If the voltage to be applied to cause the toner to jump (to be referred to as the ON potential) is enhanced in order to shorten the duration of voltage application, it is possible to reduce the time until all the toner involved has passed by the control electrode, but an increased amount of toner might jump, possibly heightening the toner density more than is required. Resultantly, the desired dots fail to be formed making it difficult to reproduce correct halftones. In order to obtain a desired amount of toner that jumps, the size of gates can conceivably be reduced. In this case, however, since large amounts of toner pass through gates at a time, the gates are liable to become clogged, quickly causing image defects and print deficiencies.

SUMMARY OF THE INVENTION

The present invention has been devised in view of the above problems, and it is therefore an object of the present invention to provide an image forming apparatus which is improved in its printing speed and quality of printing by picking out developer particles suitable for printing without needing any particular means and without increasing the potential to be applied to the control electrode for controlling the passage of the developer.

In order to achieve the above object, the present invention is configurated as follows:

In accordance with the first aspect of the invention, an image forming apparatus includes:

a supporting means for supporting the developer;

an opposing electrode disposed facing the supporting means;

a control electrode disposed between the supporting means and the opposing electrode and having a plurality of gates which form passage for the developer particles; and a controlling means which generates a predetermined potential difference between the supporting means and the opposing electrode and, by varying the potential applied to the control electrode, controls passage of the gates for the developer so as to form an image on a recording medium arranged between the control electrode and the opposing electrode, and is characterized in that the control means controls the duration of voltage application to the control electrode for the developer to jump toward the opposing electrode, to thereby pick out suitable developer particles to be used for forming images.

In accordance with the second aspect of the invention, an image forming apparatus includes:

a supporting means for supporting the developer;

an opposing electrode disposed facing the supporting means;

a control electrode disposed between the supporting means and the opposing electrode and having a plurality of gates which form passage for the developer particles; and a controlling means which generates a predetermined potential difference between the supporting means and the opposing electrode and, by varying the potential applied to the control electrode, controls passage of the gates for the developer so as to form an image on a recording medium arranged between the control electrode and the opposing electrode, and is characterized in that the control means controls the duration of voltage application to the control electrode for causing the developer to jump toward the opposing electrode in accordance with the size of the image forming area of the developer that has passed through the gate of the control electrode, to thereby control the amount of the developer transferring from the toner support to the recording medium.

In accordance with the third aspect of the invention, an image forming apparatus includes:

a supporting means for supporting the developer;

an opposing electrode disposed facing the supporting means;

a control electrode disposed between the supporting means and the opposing electrode and having a plurality of gates which form passage for the developer particles; and a controlling means which generates a predetermined potential difference between the supporting means and the opposing electrode and, by varying the potential applied to the control electrode, controls passage of the gates for the developer so as to form an image on a recording medium arranged between the control electrode and the opposing electrode, and is characterized in that the control means performs control in such a manner that the gate-facing area of the developer on the supporting means from which the developer jumps toward the gate becomes greater than the area of the pixel dot resultantly formed on the recording medium, and the duration t within which a potential causing the developer to pass through the gate is applied to the control electrode satisfies the relation $t<T$, where T is the duration with which, if an electric field equivalent to or approximately equivalent to that generated by the potential being applied to the control electrode causes the developer to jump in a system where no control electrode is present between the supporting means and opposing electrode, the resultant dot of the developer will have the maximum density.

In accordance with the fourth aspect of the invention, an image forming apparatus includes:

a supporting means for supporting the developer;

an opposing electrode disposed facing the supporting means;

a control electrode disposed between the supporting means and the opposing electrode and having a plurality of gates which form passage for the developer particles; and a controlling means which generates a predetermined potential difference between the supporting means and the opposing electrode and, by varying the potential applied to the control electrode, controls passage of the gates for the developer so as to form an image on a recording medium arranged between the control electrode and the opposing electrode, and is characterized in that the control means performs control in such a manner that the duration t within which a potential causing the developer to pass through the gate is applied to the control electrode satisfies the relation $t \geqq g^{-1}(S1*f^{-1}(IDm))$, where the function f is defined as ID=f(M1) where M1 is the amount of the developer adhering on the recording medium per unit area and ID is the dot density in the case where the adhering amount of the developer is M1, and the function g is defined as M=g(t) where M is the amount of the developer which transfers from the supporting means to the recording medium during the duration t and forms a pixel dot, S1 is the area on the recording medium onto which the developer lands, and IDm is the minimum density of a pixel dot to be formed on the recording medium in the acceptable range of pixel density.

In accordance with the fifth aspect of the invention, an image forming apparatus includes:

a supporting means for supporting the developer;

an opposing electrode disposed facing the supporting means;

a control electrode disposed between the supporting means and the opposing electrode and having a plurality of gates which form passage for the developer particles; and a controlling means which generates a predetermined potential difference between the supporting means and the opposing electrode and, by varying the potential applied to the control electrode, controls passage of the gates for the developer so as to form an image on a recording medium arranged between the control electrode and the opposing electrode, and is characterized in that the control means performs control in such a manner that the duration t within which a potential causing the developer to pass through the gate is applied to the control electrode satisfies the relation $t \geqq g^{-1}(S1*f^{-1}(IDM))$, where the function f is defined as ID=f(M1) where M1 is the amount of the developer adhering on the recording medium per unit area and ID is the dot density in the case where the adhering amount of the developer is M1, and the function g is defined as M=g(t) where M is the amount of the developer which transfers from the supporting means to the recording medium during the duration t and forms a pixel dot, S1 is the area on the recording medium onto which the developer lands, and IDM is the maximum density of a pixel dot to be formed on the recording medium in the range within which pixels are reproduced desirably.

In accordance with the sixth aspect of the invention, an image forming apparatus includes:

a supporting means for supporting the developer;

an opposing electrode disposed facing the supporting means;

a control electrode disposed between the supporting means and the opposing electrode and having a plurality of gates which form passage for the developer particles; and a controlling means which generates a predetermined potential difference between the supporting means and the opposing electrode and, by varying the potential applied to the control electrode, controls passage of the gates for the developer so as to form an image on a recording medium arranged between the control electrode and the opposing electrode, and is characterized in that the control means performs control in such a manner that the duration t within which a potential causing the developer to pass through the gate is applied to the control electrode satisfies the relation $g^{-1}(S1*f^{-1}(IDm)) \leqq t \leqq g^{-1}(S1*f^{-1}(IDM))$, where the function f is defined as ID=f(M1) where M1 is the amount of the developer adhering on the recording medium per unit area and ID is the dot density in the case where the adhering amount of the developer is M1, and the function g is defined as M=g(t) where M is the amount of the developer which transfers from the supporting means to the recording medium during the duration t and forms a pixel dot, S1 is the area on the recording medium onto which the developer lands, IDm is the minimum density of a pixel dot to be formed on the recording medium in the acceptable range of pixel density and IDM is the maximum density of a pixel dot to be formed on the recording medium in the range within which pixels are reproduced desirably.

In the above first configuration of the invention, the developer carried on the supporting means jumps to the opposing electrode in accordance with the duration of voltage application to the control electrode. During this voltage application, the developer particles will start jumping from those which jump easily. Accordingly, control of the duration of voltage application picks out suitable developer particles to be used for forming images, thus making it possible to create an improved image without needing any extra toner discriminating means. Since only the toner particles which jump easily and quickly are selectively used for image forming, from the developer carried on the supporting means, it is possible to reduce the printing time and hence improve the printing speed.

In the above second configuration of the invention, as the duration of voltage application to the control electrode is made longer, the amount of the developer transferring to the opposing electrode increases proportionally. When the duration of voltage application to the control electrode is controlled in accordance with the pixel forming area, the amount of the developer transferring to the pixel forming area can be controlled. In this way, it is possible to select an optimal printing density when printing is performed.

In the above third configuration of the invention, the developer jumping from the area of a greater region on the supporting means is adapted to converge to a pixel dot of a smaller area than that of the greater region. Accordingly, it is possible to provide printing of good quality even though the amount of the developer used here is less than that of the jumping developer required for the prior art. Since only a smaller amount of the developer that jumps is needed and effective in forming images, it is possible to perform printing in a shorter period than that required for all the toner which can be caused to jump by the control electrode to reach the control electrode. Thus, the toner which jumps under this condition is collected and used for forming a pixel dot, resultantly, it is possible to perform printing more quickly, and hence improve the printing speed.

In the above fourth embodiment, the duration of voltage application to the control electrode is set equal to or longer than the time which is determined dependent upon the dot forming area for a pixel and the minimum level of density required for forming images. Accordingly, this setting ensures the density of an image greater than a certain level even when the density of printing varies due to various factors.

In the above fifth embodiment of the invention, the duration of voltage application to the control electrode is set equal to or shorter than the time which is determined dependent upon the dot forming area for a pixel and the maximum level of density above which image forming is degraded. This setting provides images of good quality without causing any excessive increase in the density of the image. Further, it is also possible to inhibit the developer from being consumed excessively.

In the above sixth embodiment of the invention, the duration of voltage application to the control electrode is set equal to or longer than the time which is determined dependent upon the dot forming area for a pixel and the minimum level of density required for forming images and equal to or shorter than the time which is determined dependent upon the dot forming area for a pixel and the maximum level of density above which image forming is degraded. This setting provides images of good quality without causing any excessive increase in the density of the image. Accordingly, this setting neither will lower the density of the image nor increase the density more excessively than is required.

DESCRIPTION OF THE PREFERRED EMBODIMENTS

The embodiment of the invention will hereinafter be described with reference to the accompanying drawings.

Figure 1:
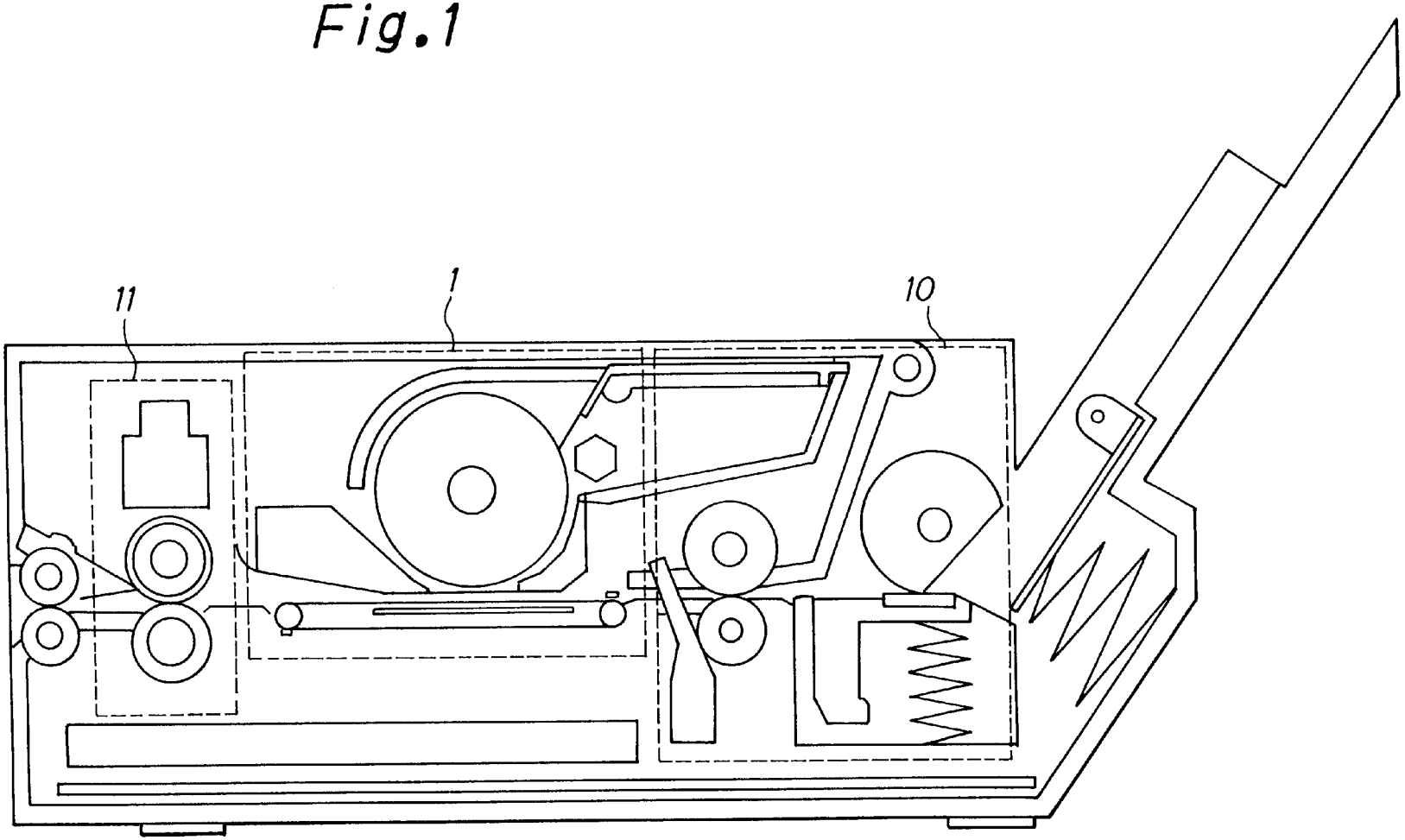
FIG. 1 is a schematic sectional view showing the overall configuration of an image forming apparatus in accordance with the present invention.
Figure 2:
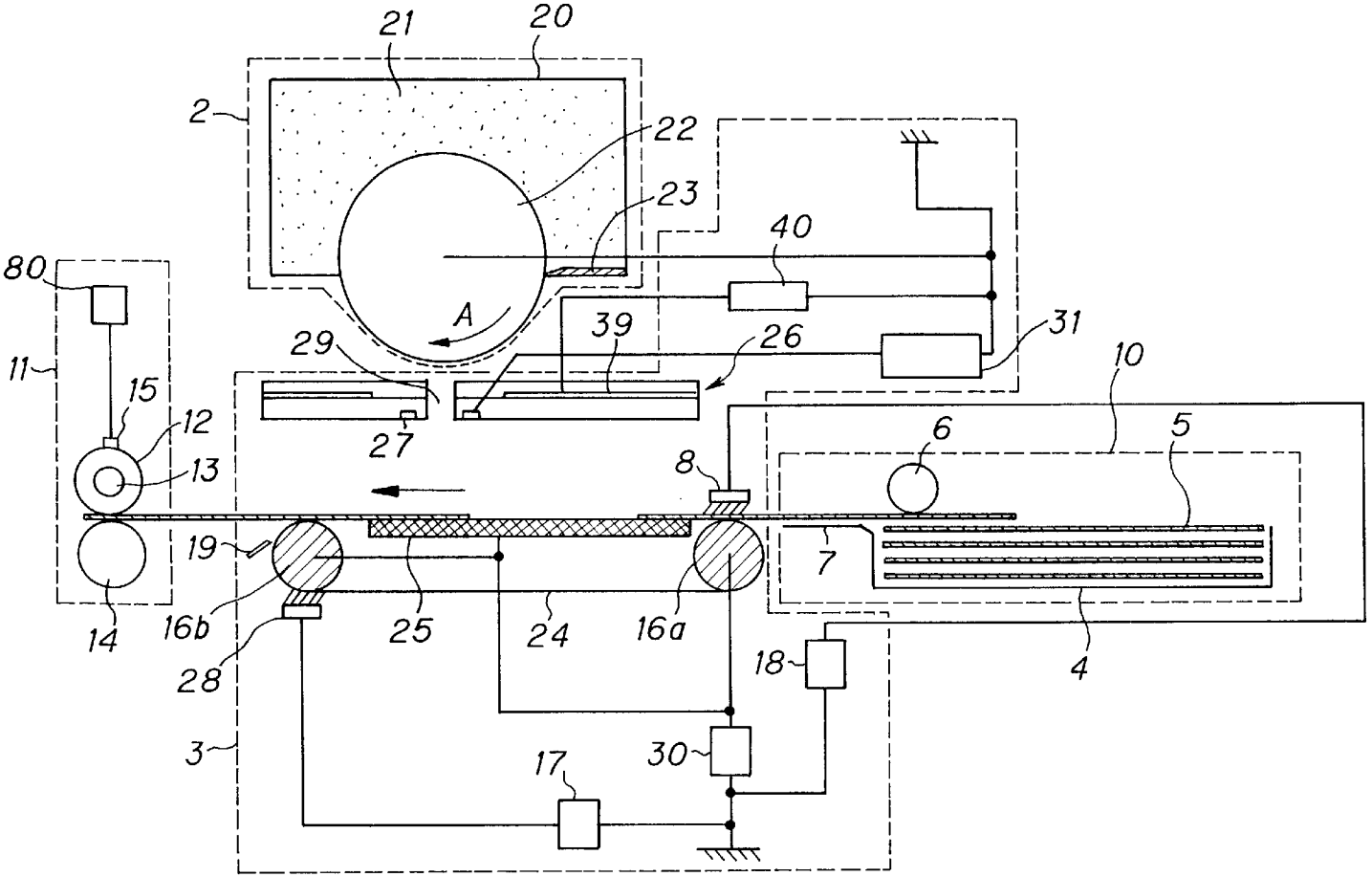
FIG. 2 is a configurational diagram schematically showing essential components of this image forming apparatus.

FIG. 1 is a schematic sectional view showing the overall configuration of an image forming apparatus in accordance with the present invention. FIG. 2 is a schematic configurational diagram showing essential components of this image forming apparatus. In the following description, the image forming apparatus with a configuration for negatively charged toner will be described, but the polarity of each voltage to be applied may be appropriately set if positive charged toner is used.

(Configuration of the apparatus)

This image forming apparatus has an image forming unit 1 which is composed of a toner supplying section 2 and a printing section 3. Image forming unit 1 creates a visual image in accordance with an image signal, onto a sheet of paper as recording medium with toner as the developer. In this image forming apparatus, the toner is selectively made to jump and adhere onto the paper whilst the jumping of the toner is controlled based on the image forming signal so as to directly create an image on the paper.

A paper feeder 10 is provided on the input side of image forming apparatus 1 to which the paper is fed. Paper feeder 10 is composed of a paper cassette 4 for storing paper 5 as recording medium, a pickup roller 6 for delivering paper 5 sheet by sheet from paper cassette 4, and a paper guide 7 for guiding fed paper 5. Paper feeder 10 further has unillustrated detecting sensors for detecting the feed of paper 5. Pickup roller 6 is rotationally driven by an unillustrated driving means.

Provided on the output side of image forming apparatus 1 from which the paper is output, is a fixing unit 11 for heating and pressing the toner image which was formed on paper 5 at the image forming unit 1, to fix it onto paper 5. Fixing unit 11 is composed of a heat roller 12, a heater 13, a pressing roller 14, a temperature sensor 15, and a temperature controller circuit 80. Heat roller 12 is made up of, for example, an aluminum pipe of 2 mm thick. Heater 13 is a halogen lamp, for example, which is incorporated in heat roller 12. Pressing roller 14 is made of e.g., silicone resin. Heat roller 12 and pressing roller 14 which are arranged opposite to each other, are pressed against one another in order to hold paper 5 in between and press it, with a pressing load, e.g. 2 kg, from unillustrated springs etc., provided at both ends of their shafts. Temperature sensor 15 measures the surface temperature of heat roller 12. Temperature controller circuit 80 is controlled by a main controller which performs the on/off operation of heater 13 and other control based on the measurement of temperature sensor 15, thus maintaining the surface temperature of heater roller 12 at, for example, 150° C. Fixing unit 11 has an unillustrated paper discharge sensor for detecting the discharge of paper 5.

The materials of heat roller 12, heater 13, pressing roller 14, etc., are not specifically limited. The surface temperature of heat roller 12 also is not specifically limited. Further, fixing unit 11 may use a fixing configuration in which paper 5 is heated or pressed to fix the toner image.

Further, although it is not shown in the drawing, the paper output side of fixing unit 11 has a paper discharge roller for discharging paper 5 processed through fixing unit 11 onto a paper output tray and a paper output tray for holding paper 5 thus discharged. The aforementioned heat roller 12, pressing roller 14 and the paper discharge roller are rotated by an unillustrated driving means.

Toner supplying section 2 in image forming unit 1 is composed of a toner storage tank 20 for storing toner 21 as the developer, a toner support 22 of a cylindrical sleeve for magnetically supporting toner 21 and a doctor blade 23 which is provided inside toner storage tank 20 to electrify toner 21 and regulate the thickness of the toner layer carried on the peripheral surface of toner support 22. Doctor blade 23 is arranged on the upstream side of toner support 22 with respect to the rotational direction thereof, spaced with a distance of about 60 $\mu$m, for example, from the peripheral surface of toner support 22. Toner 21 is of a magnetic type having a mean particle diameter of, for example, 6 $\mu$m, and is electrified with static charge of −4 $\mu$C/g to −5 $\mu$C/g by doctor blade 23. Here, the distance between doctor blade 23 and toner support 22 is not particularly limited. Also the mean particle size, the amount of static charge, etc., of toner 21 are not particularly limited, Toner support 22 is rotationally driven by an unillustrated driving means in the direction indicated by arrow A in the figure, with its surface speed set at 80 mm/sec, for example. Toner support 22 is grounded and has unillustrated magnets arranged therein, at the position opposite doctor blade 23 and at the position opposite a control electrode 26 (which will be described later). This arrangement permits toner support 22 to carry toner 21 on its peripheral surface. Toner 21 supported on the peripheral surface of toner support 22 is made to stand up in 'spikes' at the areas on the peripheral surface corresponding the positions of aforementioned magnets. Rotating speed of toner support 22 is not particularly limited. Here, the toner is supported by magnetic force, but toner support 22 can be configured so as to support toner 21 by electric force or combination of electric and magnetic forces.

Printing section 3 in image forming unit 1 includes: an opposing electrode 25 which is made up of an aluminum sheet of, for example, 1 mm thick and faces the peripheral surface of toner support 22; a high-voltage power source 30 for supplying a high voltage to opposing electrode 25; control electrode 26 provided between opposing electrode 25 and toner support 22 for controlling toner jumping; a charge erasing brush 28; a charge erasing power source 17 for applying a charge erasing voltage to charge erasing brush 28; a charging brush 8 for charging sheet 5; a charger power source 18 for supplying a charger voltage to charging brush 8; a dielectric belt 24; support rollers 16*a* and 16*b* for supporting dielectric belt 24; and a cleaner blade 19.

Opposing electrode 25 is arranged e.g., 1.1 mm apart from the peripheral surface of toner support 22. Dielectric belt 24 is made of poly(vinylidene fluoride) (PVDF) as a base material, and is 75 $\mu$m thick with a volume resistivity of $10^{10}\cdot\Omega$cm. Dielectric belt 24 is rotated by an unillustrated driving means in the direction of the arrow in the drawing, at a surface speed of 30 mm/sec. Applied to opposing electrode 25 is a high voltage, e.g., 2.3 kV from high voltage power source (controlling means) 30. This high voltage supplied from high voltage power source 30 generates an electric field between opposing electrode 25 and toner support 22, required for causing toner 21 being supported on toner support 22 to jump toward opposing electrode 25.

Charge erasing brush 28 is pressed against dielectric belt 24 at a position downstream, relative to the rotational direction of dielectric belt 24, and of control electrode 26. Charge erasing brush 28 has an erasing potential of 2.5 kV applied from charge erasing power source 17 so as to eliminate unnecessary charges remaining on the surface of dielectric belt 24.

If some toner 21 adhered to the surface of dielectric belt 24 due to a contingency such as paper jam, etc., cleaning blade 19 removes this toner 21 to prevent staining by toner 21 on the paper underside. The material of opposing electrode 25 is not particularly limited. The distance between opposing electrode 25 and toner support 22 is not particularly specified either. Further, the rotational speed of opposing electrode 25 or the voltage to be applied thereto is not particularly limited either.

Although unillustrated, the image forming apparatus includes: a main controller as a control circuit for controlling the whole image forming apparatus; an image processor for converting the obtained image data into a format of image data to be printed; an image memory for storage of the converted image data; and an image forming control unit for converting the image data obtained from the image processor into the image data to be given to control electrode 26.

Control electrode 26 is disposed in parallel to the tangent plane of the surface of opposing electrode 25 and spreads two-dimensionally facing opposing electrode 25, and it has a structure to permit the toner to pass therethrough from toner support 22 to opposing electrode 25. The electric field formed around the surface of toner support 22 varies depending on the potential being applied to control electrode 26, so that the jumping of toner 21 from toner support 22 to opposing electrode 25 is controlled.

Figure 3:
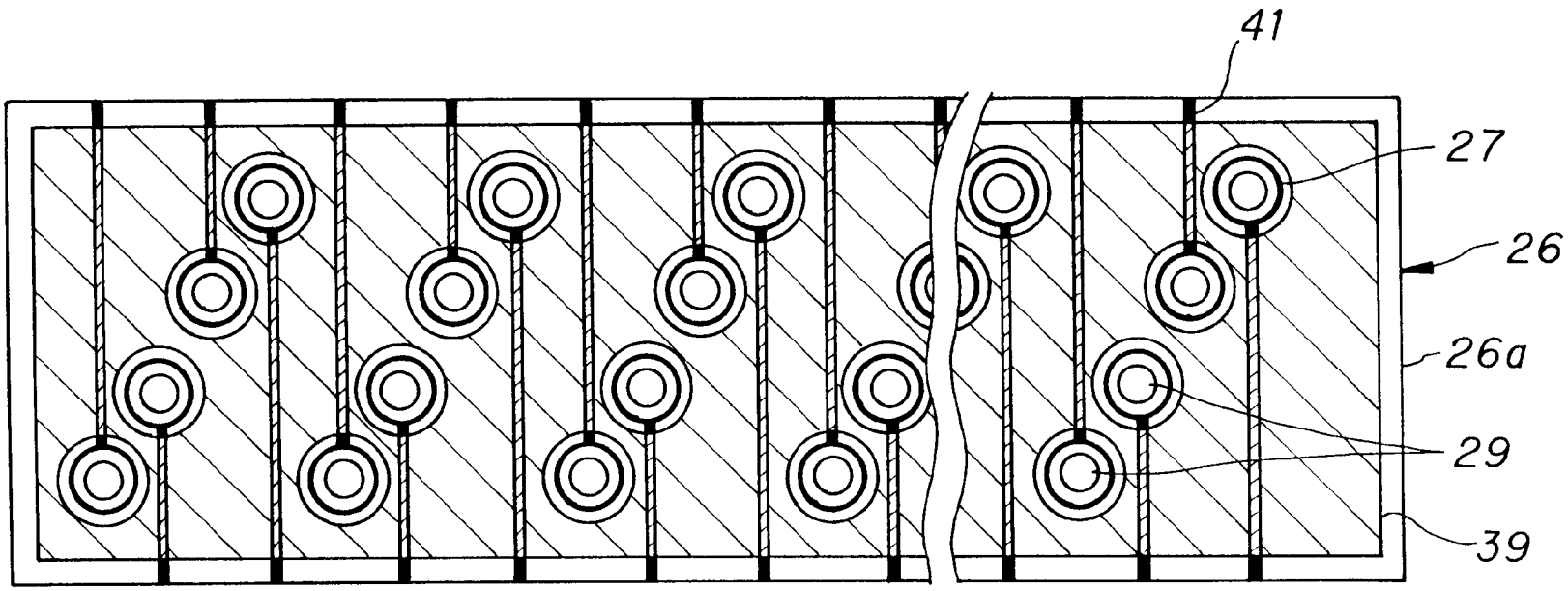
FIG. 3 is a configurational diagram schematically showing a control electrode.

Control electrode 26 is arranged so that its distance from the peripheral surface of toner support 22 is set at 100 $\mu$m, for example, and is secured by means of an unillustrated supporter member. As shown in FIG. 3, control electrode 26 is composed of an insulative board 26*a*, a high voltage driver (not shown), annular conductors independent of one another, i.e., annular electrodes 27. Board 26*a* is made from a polyimide resin, for example, with a thickness of 25 $\mu$m. Board 26*a* further has holes forming gates 29, to be mentioned later, formed therein. Annular electrodes 27 are formed of copper foil of e.g., 18 $\mu$m thick and are arranged around the holes, in a predetermined layout on the side of board 26*a* which faces opposing electrode 25. Each opening of the hole is formed with a diameter of 160 $\mu$m, for example, forming a passage for toner 21 to jump from toner support 22 to opposing electrode 25. This passage will be termed gate 29 hereinbelow. Here, the distance between control electrode 26 and toner support 22 is not particularly limited.

Further, a shield electrode 39 made up of copper foil of 18 $\mu$m thick with openings (having an aftermentioned opening diameter) at positions corresponding to gates 29 is arranged on the side facing toner support 22 of board 26*a*. The size of gates 29 and the materials and thickness of board 26*a* and annular electrodes 27 are not particularly limited. In the above case, gates 29 or the holes in annular electrodes 27 are formed at, for example, 2,560 sites. Each annular electrode 27 is electrically connected to a control power source 31 via feeder line 41 and a high voltage driver (not shown). The number of annular electrodes 27 is not particular limited.

The surface of shield electrode 39, the surface of annular electrodes 27 and the surface of feeder lines 41 are covered with an insulative layer of 30 $\mu$m thick, which ensures insulation between annular electrodes 27, insulation between feeder lines 41, insulation between annular electrodes 27 and feeder lines 41 which are not connected with each other, insulation from toner support 22 and insulation from opposing electrode 25. The material, thickness etc., of the insulative layer are not particularly limited. Here, each annular electrode 27 has an opening of 200 $\mu$m in diameter thereabove.

Supplied to annular electrodes 27 of control electrode 26 are voltages or pulses in accordance with the image signal from control power source (controlling means) 31. Specifically, when toner 21 carried on toner support 22 is made to pass toward opposing electrode 25, a voltage, e.g., 150 V is applied for a period of 180 psec to annular electrodes 27. When the toner is blocked from passing, a voltage, e.g., −200 V is applied.

Supplied to shield electrode 39 provided for control electrode 26 is a shield voltage of −100 V from a shield voltage power source 40. This shield voltage is effective in preventing toner 21 from adhering to control electrode 26 and in removing toner 21 adhering to control electrode 26 from a position of toner support 22.

In this way, whilst the potential to be imparted to control electrode 26 is controlled in accordance with the image signal, a sheet of paper 5 is fed over opposing electrode ;25 on the side thereof facing toner support 22. Thus, a toner image is formed on the surface of paper 5 in accordance with the image signal. Here, control power source 31 is controlled by a control electrode controlling signal transmitted from an unillustrated image forming control unit.

Figure 4:
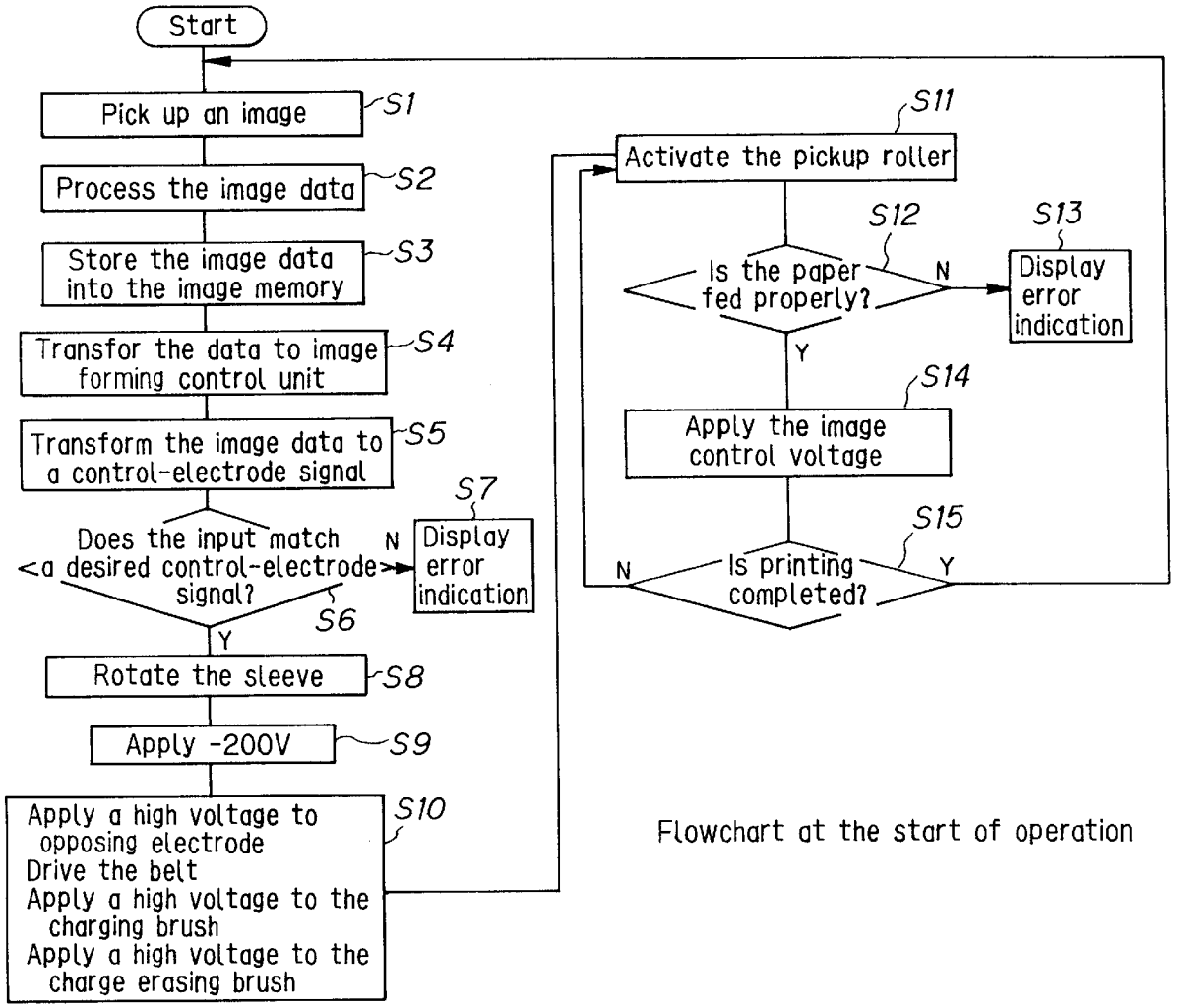
FIG. 4 is a flowchart showing the operation of the subject image forming apparatus.

The above image forming apparatus can be applied to an output printer for computers, word processors as well as the printing portion of digital copiers. The following description will be the case where the image forming operation of FIG. 4 is performed in the printing portion of a digital copier.

(Operation of the apparatus)

Next, the above image forming apparatus used for a copying operation in a digital copier will be described with reference to the flowchart shown in FIG. 4.

First, when the user operates the copy start key (not shown) with an original to be copied set on the image pickup section (not designated with reference numeral), the image pickup section starts to read the image from the original (Step S1). The image data taken from the original image by the image pickup section is image processed in the image processing section (not shown) (Step S2) to be stored into the image memory (not shown) (Step S3). This image data is then transferred to the image forming control unit (not shown) (Step S4), and is converted into a control electrode controlling signal (Step S5).

When the image forming control unit acquires a predetermined amount of the control signal (Step S6; YES), an illustrated driving means is controlled so that toner support (sleeve) 22 of image forming unit 1 starts to rotate (Step S8) and a voltage of −200 V is applied to annular electrodes of the control electrode (Step S9). Predetermined voltages are applied to opposing electrode 25, charging brush 14 and charge erasing brush 32, respectively and dielectric belt 24 is activated (Step S10). When the input does not match a desired control electrode signal (Step S6; NO), this flow is interrupted, and an error indication is displayed (Step S7).

Next, pickup roller 6 of paper feeder 10 is operated (Step S11) so as to pick up a sheet of paper 5. The paper 5 thus picked up is sent out to image forming unit 1 by a resist roller 95 and conveyed at the predetermined speed over the flat portion of opposing electrode 25 whilst it is being attracted to a paper sucking mechanism. When paper feeding is properly performed (Step S12; YES), the image forming control unit supplies the control electrode controlling signal to control power source 31 at a time synchronized with the feeding (conveyance) of paper 5. Control power source 31 applies a driving signal (image control voltage) to control electrode 26 in accordance with the control electrode controlling signal (Step S14) so as to control the jumping of the toner flow, forming a toner image on paper 5 (i.e., achieving printing). It should be noted that the predetermined amount of the control electrode controlling signal is different depending upon the configuration of the image forming apparatus. If paper feeding is not performed properly (Step S12; NO), this flow of operation is interrupted and an error indication is displayed (Step S13).

The toner image is pressed whilst being heated by fixing unit 11. Paper 5 with a toner image fixed thereon is discharged by the discharge roller onto the paper output tray. When the paper discharge sensor detects the fact that the paper is properly discharged, printing (the operation of image forming) is judged to be properly complete (Step S15; YES). Then, the operation returns to Step S1 for a subsequent original reading operation.

By the image forming operation described above, a good image is created on paper 5. Since this image forming apparatus directly forms the image on paper 5, it is no longer necessary to use a developer medium such as photoreceptor, dielectric drum, etc., which were used in conventional image forming apparatuses. As a result, the transfer operation for transferring the image from the developer medium to paper 5 can be omitted, thus eliminating degradation of the image and improving the reliability of the apparatus. Since the configuration of the apparatus can be simplified needing fewer parts, it is possible to reduce the apparatus in size and cost.

(Operation of the image forming unit)

Next, the operation of image forming unit 1 is described in detail.

The image forming apparatus of the above embodiment may be used as the printing portion of an output terminal for a computer or may be used as the printing portion of a digital copier. In either case, the method of the image forming operation itself has no difference from the other though the image signal to be processed and the way of signal exchange differ in each case.

As stated already, toner support 22 is grounded while opposing electrode 25 and support member 16*a* have a high voltage of 2.3 kV applied and charging brush 8 has a high voltage of 1.2 kV applied. As a result, negative charge is supplied to the surface of paper 5 fed between charging brush 8 and dielectric belt 24, by the potential difference between charging brush 8 and support member 16*a*. As supplied with negative charge, paper 5 is attracted to dielectric belt 24 by the static electric force of the charge and is conveyed to directly below gates 29 as dielectric belt 24 moves. The charge on the surface of dielectric belt 24 dissipates, hence, when it reaches directly below gates 29 the paper will have a surface potential of 2 kV due to the equilibrium with the potential of opposing electrode 25.

In this condition, in order for toner 21 carried on toner support 22 to pass toward opposing electrode 25, control power source 31 is caused to apply a voltage of 150 V to annular electrodes 27 of control electrode 26. When toner 21 needs to be stopped passing through gates 29, a voltage of −200 V is applied. In this way, with paper 5 being attracted to dielectric belt 24, the image is directly formed on the surface of paper 5.

In the above description, the voltage applied to annular electrodes 27 of control electrode 26 for allowing passage of toner 21 was set at 150 V as an example. This voltage, however, is not specifically limited as long as the jumping control of toner 21 can be performed as desired. Similarly, the voltage applied to opposing electrode 25, the voltage applied to charging brush 8 and the surface potential of paper 5 directly below gates 29 are not particularly limited as long as the jumping control of toner 21 can be performed as desired.

The voltage to be imparted to annular electrodes 27 of control electrode 26 to prevent passage of toner 21 should not be particularly limited without departing from the scope of the claims of the invention.

(Application time of the ON potential)

Figure 5:
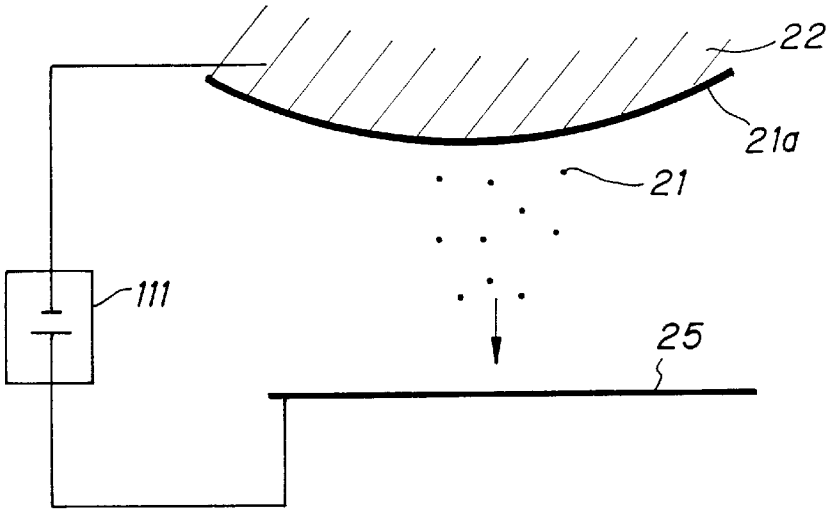
FIG. 5 is an illustrative diagram for explaining an experimental simulator for obtaining the t-D characteristic of the subject image forming apparatus.
Figure 6:
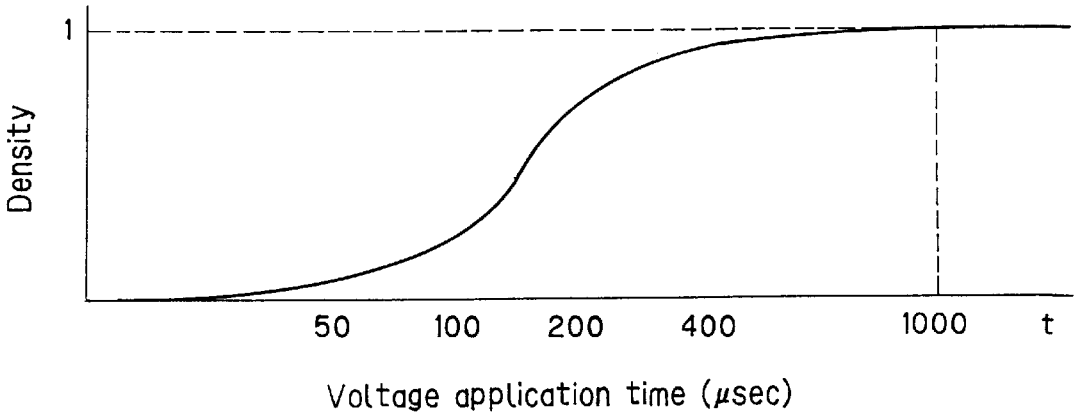
FIG. 6 is a characteristic chart showing the t-D characteristics of the subject image forming apparatus.

Now, concerning the above embodiment, description will be made of the application time of the ON potential (to be referred to hereinbelow as ON time). For this purpose, created in an experimental simulator without control electrode 26 as shown in FIG. 6 is an electric field which is equivalent to the jumping electric field formed in the surface area of the toner support 22 that faces a gate when the ON potential is applied. In this system, the relationship between the ON time and the transferred area of the adhering toner (to be referred to hereinbelow as t-D characteristics) was measured. In FIG. 5, the distance between toner support 22 and opposing electrode 25 was set at 100 μm, which is equal to the distance between toner support 22 and control electrode 26 in the above embodiment. A voltage required for creating the electric field to be formed in the gate-facing area in the above embodiment was supplied by an external power source 111. Thus an electric field was created between opposing electrode 25 and toner support 22 in the simulator.

External power source 111 was adapted so that a pulse voltage having an arbitrary pulse width could be output to regulate the forming time of the electric field. This electric field was used to cause toner 21 to jump from toner layer 21*a* formed on toner support 22 to opposing electrode 25. The toner thus transferred to opposing electrode 25 was measured. FIG. 6 shows the correlation between t and the density in the toner adhering area formed on opposing electrode 25 (t-D characteristics). In FIG. 6, the density at each time t is normalized by the density at t=1000 psec (this density is set at 1).

As shown in FIG. 6, for causing an almost saturated amount of toner 21 to jump to opposing electrode 25, or causing toner 21 providing a sufficient density to jump, t must be set as long as 400 μsec. This indicates the fact that toner 21 will not begin to jump en masse as soon as the ON field is applied. This is because, among the toner 21 that jumps, some toner 21 which jumps relatively easily starts to jump simultaneously with the application of the ON field, other toner 21 starts to jump after a certain period of time which is determined depending upon the characteristics of toner 21 and/or the toner 21 layer or the environment such as temperature and humidity. The t-D characteristics shown in FIG. 6 is liable to change easily depending upon the inherent physical properties of toner 21 such as particle size and fluidity of toner 21 in use, and additionally depending upon the supported state of it on toner support 22 such as the layer thickness of toner 21, the packing ratio of it etc. as well as the usage environment such as temperature and humidity. Needless to say, the characteristics also depend on the factors determining the electric field such as the applied voltage, the positional relation between the electrodes, and the like.

Consequently, when the toner 21 and toner support 22 used in the above embodiment are used in the above prior art, 400 μsec or longer is needed for the ON time. Suppose that the predetermined dot is formed with an ON time of 400 μsec. In this case, setting of the printing time for a single dot shorter than 400 μsec, results in an insufficiency of the dot density as well as resulting in failure to achieve faithful reproduction of halftones. In order to avoid such deficiencies, in other words, in order to shorten the ON time and still obtain a sufficient amount of toner 21, the ON potential, hence the electric field formed thereby may and should be enhanced to activate toner 21 more speedily and shorten the time for it to pass through control electrode 26.

This method, however enlarges the size of an electric-field forming area from which toner 21 will jump, resulting in an increase in the jumping amount of toner, causing a risk that the toner density will become higher than needed. In this case, it is impossible to create the desired dots, thus it becomes difficult to perform correct reproduction of halftones. To deal with this situation, it may be considered that the size of gates 29 may be made smaller in order to reduce the jumping amount of toner 21 and thereby adjust the amount of the jumping toner to a desired level. However, since, in this case, a large amount of toner jumps at a time and passes through the gate, it is liable to be come clogged, causing image defects and/or printing deficiencies.

To avoid such deficiencies, there is a method whereby the packing ratio and fed amount of toner 21 supported on toner support 22 are adjusted. However, such manipulation often alters the amount of the static charge and/or the thickness of toner 21, and further the adjustment range is very narrow and unstable, resulting in an unsuitable means for avoiding the above deficiencies.

Figure 7:
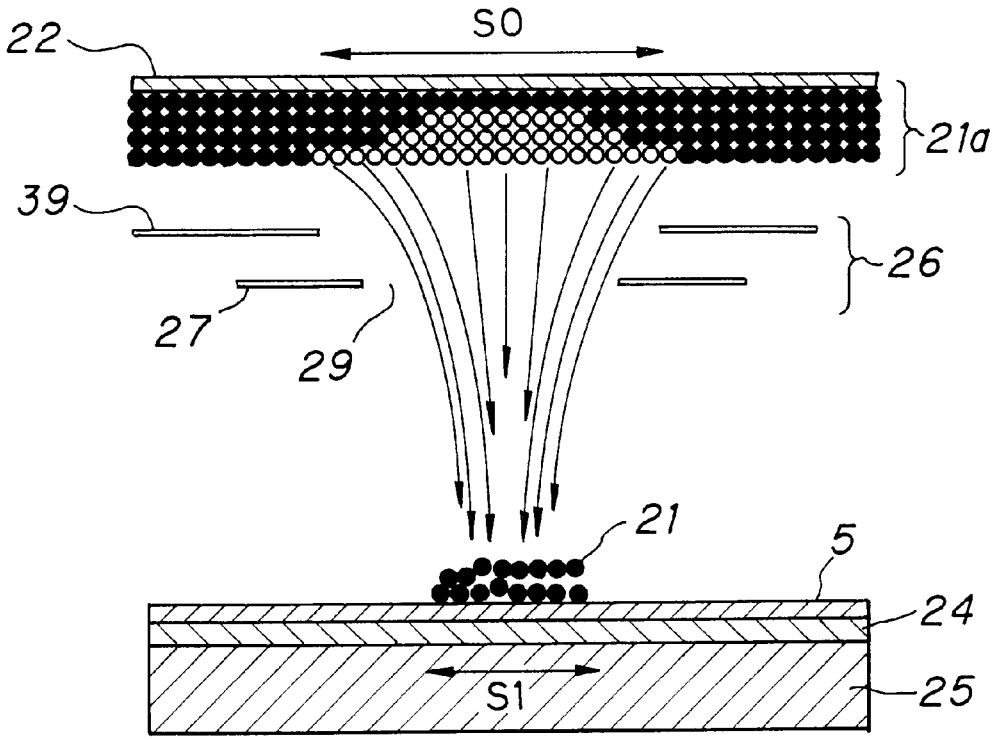
FIG. 7 is an illustrative diagram for explaining the jumping state of the toner of the subject image forming apparatus.

In the above embodiment , the ON time is set at 180 μsec. This causes a concern that the above deficiencies will occur, but they are solved in the following way. FIG. 7 shows how toner 21 jumps in this embodiment. As shown in FIG. 7, in this embodiment, the setting is controlled so that S0>S1, where S0 is the area on the surface of toner support 22 from which toner 21 jumps, and S1 is the area on paper 5 on which toner 21 lands and forms a dot. In other words, the toner 21 that jumps is adapted to converge during jumping and form a dot on paper 5. As a result, a very small amount of toner 21 jumping from a unit area on toner support 22 can produce sufficient density for the dot because the amount of toner 21 that lands on paper 5 per unit area is increased by convergence during jumping. This means that only the toner 21 which starts to jump relatively quickly from the area facing gate 29 and its proximal area on toner support 22 is used to print a dot of high enough density. Thus, it is possible to create desired dots within the ON time required for toner 21 to pass through control electrode 26, and this results in reduction of the printing time and hence improvement of the printing speed.

The above S0 and S1 easily change depending upon the inherent physical properties of toner 21 such as particle size and fluidity of toner 21 in use, and additionally depending upon the supported state of it on toner support 22 such as the layer thickness of toner 21, the packing ratio of it etc. as well as the usage environment such as temperature and humidity.

Further, they can vary depending upon the position and the applied voltage of control electrode 26, and the desired density also varies depending upon the characteristics of the image forming apparatus so that they are difficult to be determined definitively. Therefore, in order to perform printing of satisfactory density by controlling the duration of the applied voltage, the following conditions are required.

In general, when the dot density is given as ID and the amount of toner 21 formed on paper 5 per unit area is given as M1, there exists a function f which satisfies the relation ID=f(M1). If the amount of toner 21 that jumps from toner support 22 to paper 5 during the application of the ON potential is given as M, M1 can be written as M1=M/S1. Accordingly, from the above two equations, ID=f(M/S1). Since the transferring amount M of toner 21 is a function of the ON time 't' as shown in FIG. 6, M can be written as M=g(t). From the above equations, ID=f(g(t)/S1). In the above image forming apparatus, when it is assumed that the minimum density of a dot which allows the production of a satisfactory image is IDm, ID must meet ID≧IDm. From the inverse calculation from the above equations, the minimum value of the application time must satisfy $t \geqq g^{-1}(S1*f1(IDm))$.

The above ON time 't' will not always be better as it becomes longer. In the case of the jumping as shown in FIG. 7, or S0>S1, a longer ON time enhances the dot density excessively, resulting in difficulties in reproducing correct halftones and in achieving satisfactory image forming because of too large a size of dots. In order to avoid such deficiency, it is necessary to adjust the packing ratio or feed amount of toner 21 carried on toner support 22, but such adjustment also readily changes the amount of the static charge and/or the thickness of toner 21, and further the adjustment range is very narrow and unstable, resulting in an unsuitable means for avoiding the above deficiencies. Accordingly, the ON time 't' can be found from the inverse calculation of the above equations to be satisfy the relation $t \leqq g^{-1}(S1*f^{-1}(IDM))$ where IDM is the maximum value of the dot density ID.

If t is greater than the above value, the above deficiencies occur, besides, an excessive amount of toner is consumed resulting in increase in the running costs. Thus, from the above two relations, the most suitable value for the ON time can be limited to $g^{-1}(S1*f^{-1}(IDm)) \leqq t \leqq g^{-1}(S1*f^{-1}(IDM))$.

The above functions f and g also easily change depending upon the inherent physical properties of toner 21 such as particle size, fluidity and the type of the resin of toner 21 in use, and additionally depending upon the supported state of it on toner support 22 such as the layer thickness of toner 21, the packing ratio of it etc. as well as the usage environment such as temperature and humidity. Further, they can vary depending upon the position and the applied voltage of control electrode 26, and the desired density also varies depending upon the characteristics of the image forming apparatus so that they are difficult to be determined definitely. Further, as in the above embodiment in which shield electrode 39 is provided for control electrode 26, the above parameters also readily change depending upon the size and arrangement of the openings in shield electrode 39 and the applied voltage thereto. Accordingly, the above conditions are preferably adjusted to appropriate states by manipulating the above various parameters.

As above, in the above embodiment, only the toner suitable for high speed image forming is selectively picked up from the area of gate 29 and its proximal area to be used for forming images. In the above prior art, the system is configured such that the toner unsuitable for image forming is removed from the toner support upstream of the gates before the toner faces them, so that only the toner 21 which is suitable for image forming will be fed to the area where it faces the gates. However, even in this configuration, not all the toner that is conveyed to face the gates is suitable for image forming. For example, toner particles typically will not exist individually but form aggregations of plural particles. Theses aggregations may jump to feeder lines 41 on the control electrode due to the potential of feeder lines 41 before the aggregations are conveyed to the gate-facing area. The state of the aggregations readily changes due to repeated actions such as transfer to and from the toner support or vibrations, and the aggregations may easily change into a state that is not suitable for forming images. Accordingly, in the above prior art, it is difficult to form images only from toner which has perfect and excellent characteristics. Moreover, the above prior art configuration needs more parts and hence cannot avoid increase in size and cost.

On the other hand, in accordance with the present invention, since only the toner 21 which is suitable for image forming is picked out in the area facing the gates by manipulating the duration of the ON time and is used for forming images, it is possible to definitely form imagesusing only the toner 21 of good quality without causing any increase in cost. Although the above embodiment has a configuration using shield electrode 39, it is also possible to use a configuration having annular electrodes 27 only.

Figure 8:
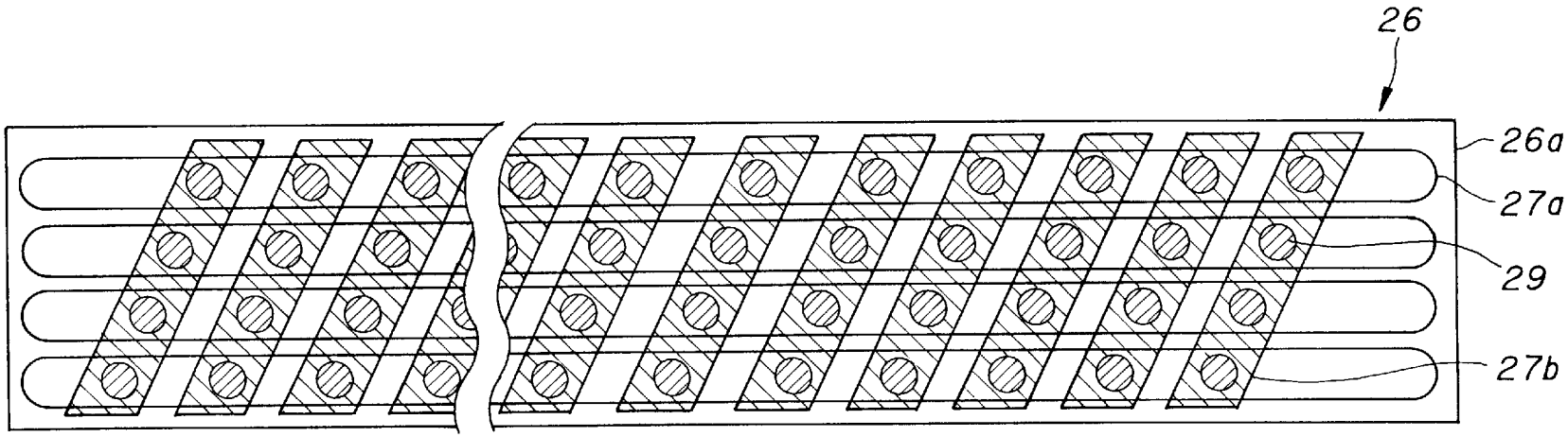
FIG. 8 is a configurational diagram schematically showing another control electrode.

Further, in the above description of the embodiment, although a single driver control was explained wherein jumping of toner 21 through each gate 29 is controlled by a different electrode, it is also possible to apply the present invention in the same manner to the case where a control electrode having strip-like electrodes 27*a* and 27*b* arranged as shown in FIG. 8 and driven by matrix control is used, thus achieving image forming of good quality. FIG. 8 shows a case where no shield electrode 39 is provided, but it is also possible to use a configuration with a shield electrode 39 provided. In the case of a control electrode driven by matrix control, the number of FETs used for the switching circuit for switching the application voltage can be markedly reduced, and hence this design is very effective in reducing the cost, although the time assigned for one dot is also reduced. For example, in the case of control electrode 26 shown in FIG. 8, the printing time is reduced to about one-fourth as compared to the case of control electrode 26 for single driver control shown in FIG. 3. When strip-like electrodes 27*a* are further increased in number, the print time being able to be allotted for each dot is shorten still more, causing difficulty in printing unless this embodiment is applied. In this way, the present invention is very effective in shortening the time for printing.

(Color image forming apparatus)

Figure 9:
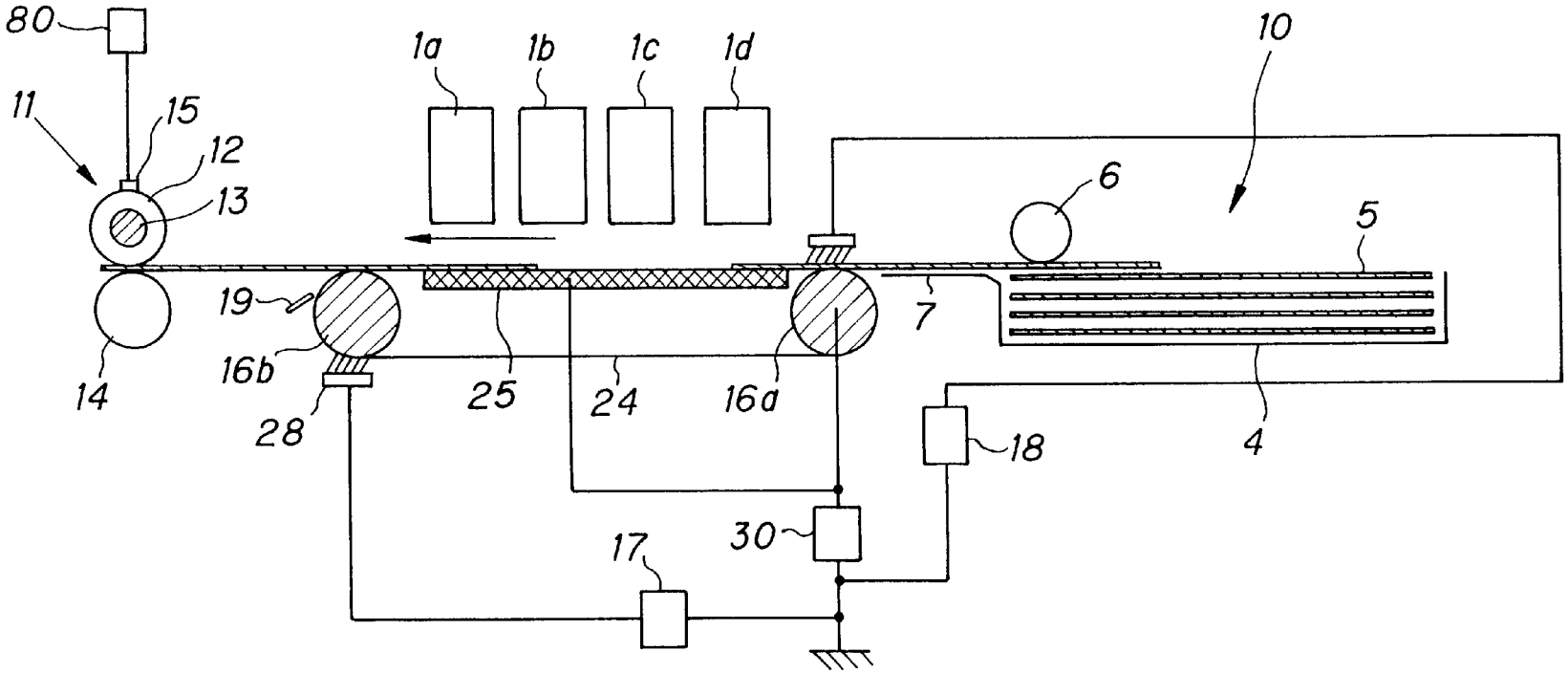
FIG. 9 is a configurational view schematically showing essential components of a color image forming apparatus.

In the above description of the embodiment, a monochrome image forming apparatus was illustrated. The present invention can also be applied to a color image forming apparatus with an increased effectiveness. For example, a color image forming apparatus may be configured by providing a plurality of image forming units 1*a*, 1*b*, 1*c* and 1*d* made up of plural toner supplying sections and printing sections wherein the toner supplying sections are filled with color toners, e.g., yellow, magenta, cyan and black. In FIG. 9, image forming units 1*a*, 1*b* 1*c* and 1*d* corresponding to yellow, magenta, cyan and black, to each of which the present invention is applied, are provided and color images are formed in accordance with image data of respective colors. The other components may be the same as those in FIG. 2.

In the case of a color image forming apparatus, if the ON time is not appropriate, or if the ON time is too short or too long, the desired amount of toner 21 will not jump, which makes it fail to form a correct density of dots. This not only causes the aforementioned problems but also fails to provide the desired size of dots because of the failure of the desired amount of toner transfer. This defect gives rise to a new problem of in correct reproduction of colors. In contrast, in accordance with the invention, the above deficiencies will not occur at all, so that it is possible to perform the desired reproduction of colors and hence excellent color image forming.

(Other references)

In the description of the embodiment, an example where toner is used as the developer was explained, but ink etc. can be used as the developer. It is also possible to construct toner supplying section 2 with a structure using an ion flow process. Specifically, the image forming unit may include an ion source such a corona charger or the like. Also in this case, it is possible to provide the same operations and effects as stated above.

In the description of the embodiment, an example where toner is used as the developer was explained, but ink etc. can also be used as the developer. The image forming apparatus in accordance with the invention can be preferably applied to the printing unit in digital copiers, facsimile machines as well as to digital printers, plotters, etc.

In accordance with the above first configuration of the invention, since only the toner particles which are suitable for printing are selectively used from the developer carried on the supporting means, by manipulating the duration of voltage application to the control electrode, it is possible to form an improved image without needing an extra discriminating means for the developer and hence extra cost. Further, since only the toner particles which jump easily and quickly can be picked out from the developer carried on the supporting means and used for image forming, it is possible to reduce the printing time and hence improve the printing speed.

In accordance with the above second configuration of the invention, since the amount of the developer effective in forming images among the developer carried on the supporting means is determined by the pixel dot forming area and the duration of voltage application to the control electrode, it is possible to control the image density suitably and hence reproduce correct halftones.

In accordance with the above third configuration of the invention, since the image forming process is controlled in such a manner that the area on the supporting means from which the developer jumps toward the gate is set greater than the area of the pixel dot resultantly formed on the recording medium, it is possible to achieve satisfactory printing even though all the developer that can be caused to jump by the control electrode will not reach the control electrode. Further, since it is possible to perform printing in a shorter period than that required for all the toner which can be caused to jump by the control electrode to reach the control electrode and toner which jumps under this condition is collected and used for forming a pixel dot, it is possible to perform printing more quickly, and hence improve the printing speed.

In accordance with the above fourth embodiment, since the duration of voltage application to the control electrode is determined dependent upon the dot forming area for a pixel and the minimum level of density required for forming images, it is possible to form images of good quality without lowering the density of the image.

In accordance with the above fifth embodiment of the invention, since the duration of voltage application to the control electrode is determined dependent upon the dot forming area for a pixel and the maximum level of density above which image forming is degraded, it is possible to provide images of good quality without causing any excessive increase in the density of the image. Further, it is also possible to inhibit the developer from being consumed excessively and hence reduce the running costs.

In accordance with the above sixth embodiment of the invention, since the duration of voltage application to the control electrode is determined dependent upon the dot forming area for a pixel and the minimum level of density required for forming images and also dependent upon the dot forming area for a pixel and the maximum level of density above which image forming is degraded, it is possible to form images of good quality without lowering the density of the image or increasing the density more excessively than is required. Further, it is also possible to inhibit the developer from being consumed excessively and hence reduce the running costs.

What is claimed is:

1. An image forming apparatus comprising:

a supporting means for supporting the developer;

an opposing electrode disposed facing the supporting means;

a control electrode disposed between the supporting means and the opposing electrode and having a plurality of gates which form passage for the developer particles; and a controlling means which generates a predetermined potential difference between the supporting means and the opposing electrode and, by varying a potential applied to the control electrode, controls passage of the gates for the developer so as to form an image on a recording medium arranged between the control electrode and the opposing electrode, wherein the controlling means performs control in such a manner that a gate-facing area of the developer on the supporting means from which the developer jumps toward the gate becomes greater than an area of a pixel dot resultantly formed on the recording medium, and a duration t within which the potential causing the developer to pass through the gate is applied to the control electrode satisfies a relation $t<T$, where T is the time duration with which, if an electric field equivalent to or approximately equivalent to that generated by the potential being applied to the control electrode causes the developer to jump in a system where no control electrode is present between the supporting means and opposing electrode, the resultantly formed pixel dot of the developer will have the maximum density.

2. An image forming apparatus comprising:

a supporting means for supporting the developer;

an opposing electrode disposed facing the supporting means;

a control electrode disposed between the supporting means and the opposing electrode and having a plurality of gates which form passage for the developer particles; and a controlling means which generates a predetermined potential difference between the supporting means and the opposing electrode and, by varying a potential applied to the control electrode, controls passage of the gates for the developer so as to form an image on a recording medium arranged between the control electrode and the opposing electrode, wherein the controlling means performs control in such a manner that a duration t within which a potential causing the developer to pass through the gate is applied to the control electrode satisfies a relation $t \geqq g^{-1}(S1*f^{-1}(IDm))$, where the function f is defined as ID=f(M1) where M1 is the amount of the developer adhering on the recording medium per unit area and ID is the dot density in the case where the adhering amount of the developer is M1, and the function g is defined as M=g(t) where M is the amount of the developer which transfers from the supporting means to the recording medium during the duration t and forms a pixel dot, S1 is the area on the recording medium onto which the developer lands, and IDm is the minimum density of a pixel dot to be formed on the recording medium in the acceptable range of pixel density.

3. An image forming apparatus comprising:

a supporting means for supporting the developer;

an opposing electrode disposed facing the supporting means;

a control electrode disposed between the supporting means and the opposing electrode and having a plurality of gates which form passage for the developer particles; and a controlling means which generates a predetermined potential difference between the supporting means and the opposing electrode and, by varying a potential applied to the control electrode, controls passage of the gates for the developer so as to form an image on a recording medium arranged between the control electrode and the opposing electrode, wherein the controlling means performs control in such a manner that a duration t within which a potential causing the developer to pass through the gate is applied to the control electrode satisfies a relation $t \leqq g^{-1}(S1*f^{-1}(IDM))$, where the function f is defined as ID=f(M1) where M1 is the amount of the developer adhering on the recording medium per unit area and ID is the dot density in the case where the adhering amount of the developer is M1, and the function g is defined as M=g(t) where M is the amount of the developer which transfers from the supporting means to the recording medium during the duration t and forms a pixel dot, S1 is the area on the recording medium onto which the developer lands, and IDM is the maximum density of a pixel dot to be formed on the recording medium in the range within which pixels are reproduced desirably.

4. An image forming apparatus comprising:

a supporting means for supporting the developer;

an opposing electrode disposed facing the supporting means;

a control electrode disposed between the supporting means and the opposing electrode and having a plurality of gates which form passage for the developer particles; and a controlling means which generates a predetermined potential difference between the supporting means and the opposing electrode and, by varying ia potential applied to the control electrode, controls passage of the gates for the developer so as to form an image on a recording medium arranged between the control electrode and the opposing electrode, wherein the controlling means performs control in such a manner that a duration t within which a potential causing the developer to pass through the gate is applied to the control electrode satisfies a relation $g^{-1}(S1*f^{-1}(IDm)) \leqq t \leqq g^{-1}(S1*f^{-1}(IDM))$, where the function f is defined as ID=f(M1) where M1 is the amount of the developer adhering on the recording medium per unit area and ID is the dot density in the case where the adhering amount of the developer is M1, and the function g is defined as M=g(t) where M is the amount of the developer which transfers from the supporting means to the recording medium during the duration t and forms a pixel dot, S1 is the area on the recording medium onto which the developer lands, IDm is the minimum density of a pixel dot to be formed on the recording medium in the acceptable range of pixel density and IDM is the maximum density of a pixel dot to be formed on the recording medium in the range within which pixels are reproduced desirably.

* * * * *